US007333125B2

(12) United States Patent
Phillips et al.

(10) Patent No.: US 7,333,125 B2
(45) Date of Patent: Feb. 19, 2008

(54) MARKING REPLACEABLE RESOURCE UNITS WITHIN PRINTING DEVICES

(75) Inventors: Quintin T. Phillips, Boise, ID (US); Michael C. Allyn, Boise, ID (US); David M. Payne, Star, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 262 days.

(21) Appl. No.: 10/975,305

(22) Filed: Oct. 27, 2004

(65) Prior Publication Data

US 2006/0098084 A1 May 11, 2006

(51) Int. Cl.
*B41J 2/435* (2006.01)
*B41J 2/47* (2006.01)

(52) U.S. Cl. ..... 347/224; 347/225

(58) Field of Classification Search ..... 347/224–225, 347/228, 230–231, 240, 251; 399/11, 24–30, 399/12, 61–64; 219/121.68; 216/87
See application file for complete search history.

(56) References Cited

U.S. PATENT DOCUMENTS

| | | | | |
|---|---|---|---|---|
| 4,904,340 | A * | 2/1990 | Miracky et al. | 216/87 |
| 5,699,091 | A | 12/1997 | Bullock et al. | |
| 5,758,224 | A | 5/1998 | Binder | |
| 5,965,042 | A * | 10/1999 | Saitoh | 219/121.68 |
| 6,324,350 | B1 * | 11/2001 | Ito et al. | 399/12 |
| 6,487,378 | B1 * | 11/2002 | Ono | 399/12 |
| 2004/0147399 | A1 | 7/2004 | Gore | |

FOREIGN PATENT DOCUMENTS

EP 1060895 A1 12/2000

* cited by examiner

*Primary Examiner*—Hai Pham

(57) ABSTRACT

A marking beam of electromagnetic energy is generated within a printing device and a visibly markable portion of a replaceable subsystem that is at least partially arranged within the printing device is altered by illuminating at least part of the markable portion with the marking beam.

33 Claims, 5 Drawing Sheets

MARKING REPLACEABLE RESOURCE UNITS WITHIN PRINTING DEVICES

BACKGROUND

Printing devices often include resource units. Such resource units are designed to be periodically replaced. Some replaceable resource units can be refurbished in some manner and reused. Most replaceable resources have limited lifetimes due to normal wear, etc. Unfortunately, it can be difficult to identify how much, how often and/or for how long a replaceable resource unit has been used. Such determinations would be useful, for example, when addressing warranty issues associated with the printing device and/or replaceable resource, purchasing refurbished units, and/or at other times.

BRIEF DESCRIPTION OF THE DRAWINGS

The following detailed description refers to the accompanying figures. In the figures, the left-most digit(s) of a reference number identifies the figure (FIG.) in which the reference number first appears. Moreover, the same reference numbers are used throughout the drawings to reference like features and components.

DETAILED DESCRIPTION

Methods and apparatuses are provided wherein a markable portion of a replaceable resource unit is selectively altered by illuminating the markable portion with a marking beam. The alteration of the markable portion is visible to users and/or machines and indicative of some information associated with the replaceable resource unit. The replaceable resource unit is marked in this manner while installed (fully or partially) within a printing device.

The marking beam may be directly output by one or more sources in a manner to illuminate the markable portion, or may be redirected or otherwise changed by one or more intermediate beam directing mechanisms before illuminating the markable portion. The marking beam may include, for example but not by way of limitation, a steady beam, a selectively moved/moving beam, a spot beam, a shaped beam, a split beam, a filtered beam, a focused beam, an unfocused beam, a beam having selectable intensity, a beam having a specific frequency or frequencies, an amplified beam, a pulsed beam, a polarized beam, an non-polarized beam, and/or the like.

The replaceable resource unit may be configured, for example but not way of limitation, as all or partially non-moving or all or partially moved/moving resource unit during the marking process. The replaceable resource unit may also be configured to selectively expose the markable portion during the marking process. The exposure of the markable portion may be conducted, for example, by selectively relocating or otherwise moving all or part of the replaceable resource unit with an engaging unit or other like capability that is part of the printing device and/or the replaceable resource unit.

Figure 1:
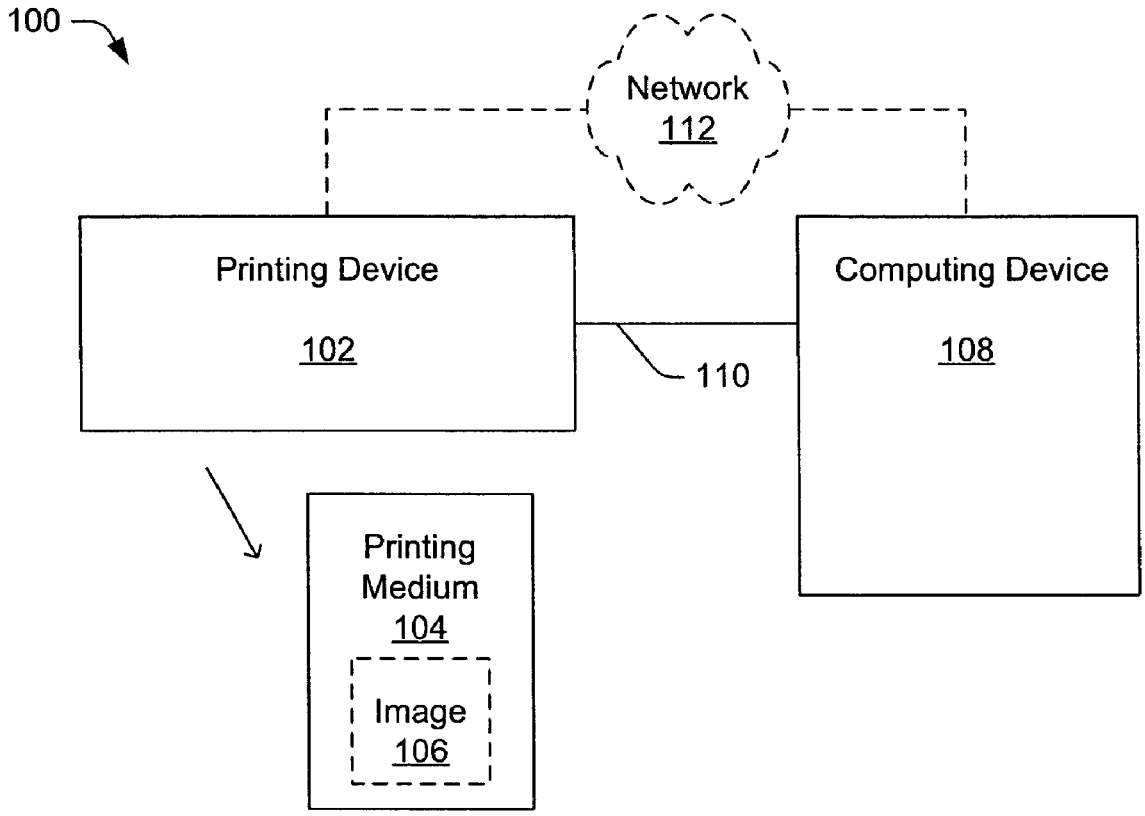
FIG. 1 is a block diagram depicting an exemplary system having a printing device, in accordance with certain embodiments of the present invention.

Attention is first drawn to FIG. 1, which is a block diagram depicting an exemplary system 100 having a printing device 102. Printing device 102 is configured to form an image 106 on a print medium 104. In certain implementations, printing device 102 may include a monochromatic or color printer such as, for example, a laser printer, an inkjet printer, a thermal printer, an electrophotographic copier, or other like printing device. Print medium 104 includes any material on to which image 106 may be formed by printing device 102. Thus, by way of example but not limitation, exemplary print medium 104 includes paper, plastic, and/or the like. Image 106 is representative of any printable image, including, for example, text, graphics, digital images, and/or the like. Image 106 can be formed by printing device 102 on print medium 104 by depositing ink, toner or other like material on print medium 104. In a thermal printer, image 106 is formed by selectively application of thermal energy to print medium 104.

System 100 further illustrates that printing device 102 may be operatively coupled to other devices, such as, computing device 108 via a connection 110 and/or a network 112. Computing device 108 is representative of any device that is capable of outputting information that printing device 102 uses to form image 106 on print medium 104. Thus, by way of example, but not limitation, computing device 108 may include a computer such as a workstation, laptop, personal computer, server, or the like, an appliance such as a scanner, a hand-held device such as a personal digital assistant or the like, a digital camera device, such as a digital still camera, a digital video camera, a wireless telephone with integral digital camera, etc. Connection 110 may include a wired or wireless connection. Network 112 is representative of any communication system or systems that are configured to promote communication of information between computing device 108 and printing device 102. Thus, for example, in certain implementations, network 112 includes a wired and/or wireless local area and/or wide area network, an intranet, the Internet, and/or other like communication systems/resources.

Figure 2A:
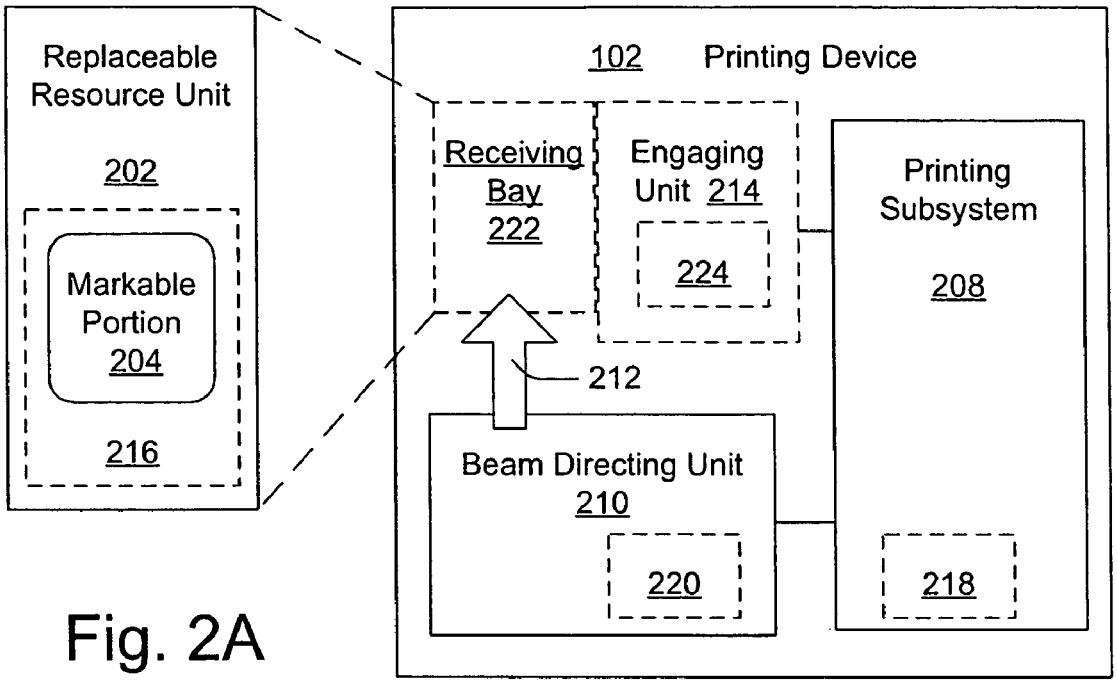
FIGS. 2A and 2B are block diagrams depicting, in greater detail, two exemplary printing devices, for example, as in FIG. 1, having beam directing units and replaceable resource units, in accordance with certain embodiments of the present invention.
Figure 2B:
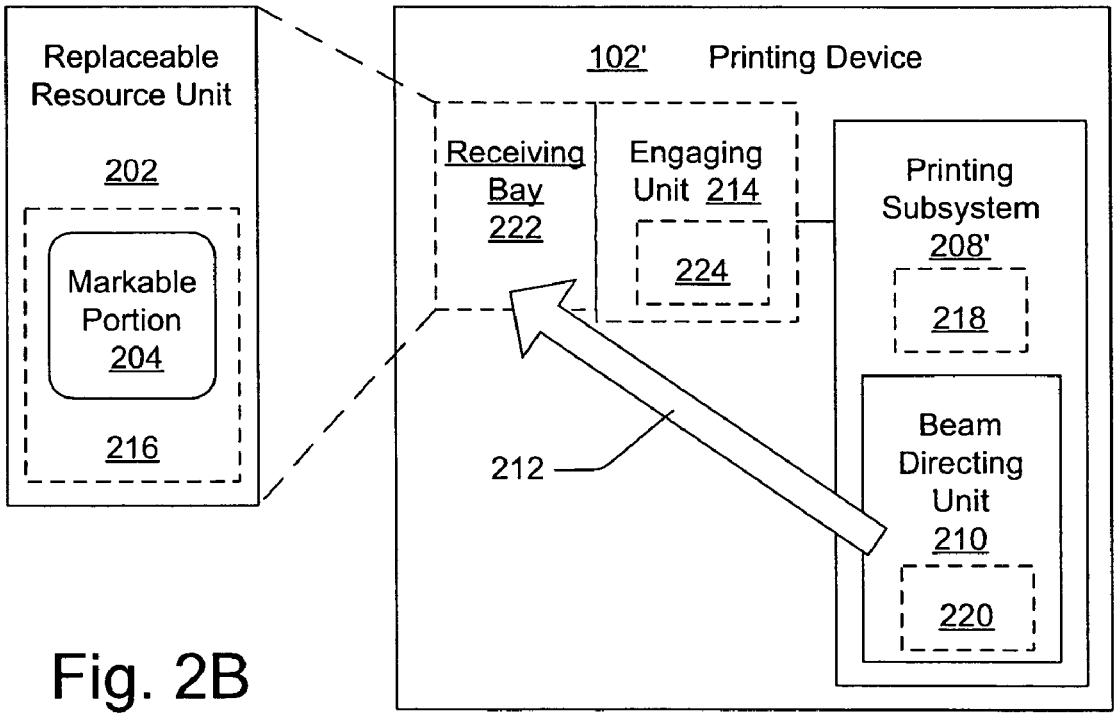

FIGS. 2A and 2B are block diagrams depicting, in greater detail, two exemplary printing devices, for example, as in FIG. 1, having beam directing units and replaceable resource units in accordance with certain exemplary implementations.

As illustrated in FIG. 2A, printing device 102 is configured to receive a replaceable resource unit 202. Replaceable resource unit 202 is representative of any replaceable resource associated with printing device 102. Thus, by way of example but not limitation, replaceable resource unit may include a toner cartridge, an ink cartridge, a printhead, an electrostatic transfer belt assembly, a transfer drum, a fuser assembly, a waste toner container, laser assembly, or the like.

Replaceable resource unit 202 includes at least one markable portion 204. Markable portion 204 is configured to be altered when properly illuminated by a marking beam of electromagnetic energy 212. In this manner, markable portion 204 is selectively visibly altered while in printing device 102 such that a person and/or machine can subsequently determine that markable portion 204 has been marked.

In certain exemplary implementations markable portion 204 includes one or more materials arranged on or otherwise integrated with replaceable resource unit 202 that is responsive to marking beam 212 to produce the desired visibly altered state.

Electromagnetic energy markable materials are well known. For example, there are markable materials that chemically react and visibly change in some manner when properly illuminated by electromagnetic energy. There are also, for example, markable materials that heat up when properly illuminated by electromagnetic energy such that the resulting thermal change causes the material and/or other nearby materials to visibly change in some manner.

Further examples of exemplary marking materials are those related to visibly marking compact discs (CDs), digital versatile discs (DVDs) or the like. Here one or more layers of one or more materials are provided on the disc or other like object and visibly written to using a laser or other like beam. Thus, for example, and incorporated herein by reference, are U.S. Pat. No. 6,771,297 titled "Labeling Apparatus And Method For Disk Storage Media" and U.S. Pat. No. 6,778,205 titled "Methods and Apparatuses for Forming Visible Labels on Objects Using a Writable Optical Disc Drive". These patents disclose some exemplary markable materials.

By way of further example of an electromagnetic radiation sensitive composition includes a leuco dye or the like that is capable of forming a black image upon development. Here, for example, the leuco dye may include an isobenzofuranone-containing dye. The electromagnetic radiation sensitive composition may also comprise an activator configured for reaction with the leuco or other like dye. The electromagnetic radiation sensitive composition may also comprise an electromagnetic radiation absorber admixed with or in thermal contact with the leuco or other like dye, which is thermally active under the influence of electromagnetic radiation sufficient to facilitate the reaction.

Some exemplary marking materials may include an antenna material, a color former material and an activator material, all dispersed in a matrix. Here, the color former material and the activator material can be present in the imaging material in two separate phases. The antenna material absorbs electromagnetic energy that heats the mixture which causes the color former material and the activator material to mix and react, causing the color former material to change color.

As used above, the term "leuco dye" refers to a color forming substance which is colorless or one color in a non-activated state and produces or changes color in an activated state. The term "activator material" refers to a substance which reacts with a leuco or like dye and causes the leuco or like dye to alter its chemical structure and change and/or acquire color. By way of example, activator materials may be phenolic or other proton donating species which can effect this change. The term "antenna material" refers to any electromagnetic radiation absorbing compound that absorbs a desired wavelength of the marking beam.

Those skilled in the art will recognize that other types of marking materials may be used and that only a few examples have been described herein.

In certain exemplary implementations, markable portion 204 is applied directly to a surface of replaceable resource unit 202, for example, by silk-screening, painting, or other like printing technique. As further illustrated in FIG. 2A, markable portion 204 may be affixed or otherwise applied to replaceable resource unit 202 by way of a label 216 or like object. In still other exemplary implementations, surface material of replaceable resource unit 202 may itself be configured as markable portion 204 and mark responsive to marking beam 212.

Printing device 102, in this example, includes a printing subsystem 208 that is configured to print image 106 on print medium 104 (FIG. 1). For example, printing subsystem may include circuitry and associated mechanisms to form image 106 on print medium 104 user laser printing techniques, inkjet printing techniques, thermal printing techniques, electrophotographic printing techniques, or the like. Such techniques are well known.

Printing device 102 also includes a beam directing unit 210 that is operatively coupled to printing subsystem 208. Beam directing unit 210 is configured to selectively output marking beam 212 and illuminate all or part of markable portion 204 with marking beam 212. Beam directing unit 210 is described in greater detail below.

As illustrated in FIG. 2A, printing device 102 also includes a receiving bay 222 that is configured to operatively receive replaceable resource unit 202. In certain implementations, receiving bay 222 is configured such that, when installed, all of replaceable resource unit 202 is arranged within a main housing 224 of printing device 102. In certain other implementations, receiving bay 222 is configured such that, when installed, only a part of replaceable resource unit 202 is arranged within main housing 224. In certain implementations, markable portion 204 is arranged with main housing 224 when replaceable resource unit 202 is installed in printing device 102.

The type(s) of replaceable resource(s) associated replaceable resource unit 202 dictate the operative features of receiving bay 222. For example, if the replaceable resource includes toner then receiving bay 222 may be configured to physically support the replaceable resource unit (e.g., toner cartridge) and receive toner there from, and also provide electrical and/or mechanical interfacing features supporting printing subsystem 208 access, acceptance, or use of the replaceable resource.

Receiving bay 222 is also configured to allow beam directing unit 210 to illuminate all or part of markable portion 204 with marking beam 212 when replaceable resource unit 202 is properly installed in receiving bay 222.

In certain implementations, printing device 102 also includes an engaging unit 214. As illustrated in FIG. 2A, optional engaging unit 214 is operatively coupled to receiving bay 222 and/or replaceable resource unit 202 when installed in receiving bay 222. Engaging unit 214 is configured to respond to command signals, for example from printing subsystem 208 printing subsystem 208, by physically moving at least a portion of replaceable resource unit 202 with respect to marking beam 212. In this manner, marking beam 212 can illuminate markable portion 204 in at least one direction, e.g., the direction in which replaceable resource unit 202 moves.

In certain exemplary implementations, a larger two dimensional mark is formed on markable portion 204 when replaceable resource unit 202 is moved in the direction of one axis (e.g., a y-axis) by engaging unit 214 and marking beam 212 is moved in the direction of another axis (e.g., an x-axis, perpendicular to the y-axis) by beam directing unit 210. The same mark is formed in other implementations by moving at least of portion of replaceable resource unit 202 in two directions using engaging unit 214, while marking beam 212 is not moved. In still other implementations, when engaging unit 214 is not present and hence replaceable resource unit 202 is not moved, such a larger two dimensional mark is formed on markable portion 204 by moving marking beam 212 accordingly (e.g., in two dimensions) across markable portion 204 using beam directing unit 210.

While engaging unit 214 is illustrated in FIG. 2A as being separate from replaceable resource unit 202, in other exemplary implementations all or part of the functionality of engaging unit 214 may be incorporated into replaceable resource unit 202. Thus, for example, in such implementations all or part of replaceable resource unit 202 may be operatively configured to move itself in response to one or more inputs from printing subsystem 208.

Those skilled in the art will recognize that a variety of controls and/or mechanisms may be configured to selectively move all or part of replaceable resource unit 202. By way of example but not limitation, engaging unit 214, receiving bay 222 and/or replaceable resource unit 202 may include one or more actuators, motors, levers, gears, cams, rods, circuits, and the like configured to cause the selective movement of markable portion 204 with respect to marking beam 212.

As illustrated in the exemplary implementation of FIG. 2A, marking logic 218, 220, 224, or other like circuitry may be provided in printing subsystem 208, beam directing unit 210, and engaging unit 214, respectively. Marking logic 218 in this implementation is configured to perform a marking operation by causing corresponding marking logic 220 in beam directing unit 210 to output marking beam 212 and possibly direct, redirect, move, or otherwise adjust marking beam 212 as desired to mark markable portion 204. Marking logic 218 can be configured to support the marking operation by causing corresponding marking logic 224 in engaging unit 208 to selectively move, or otherwise adjust all or part of replaceable resource unit 202 as desired for marking beam 212 to illuminate and mark markable portion 204. While not illustrated in FIG. 2A, it should also be clear that in certain other implementations marking logic 224 or the like may be incorporated as needed in replaceable resource unit 202 and/or receiving bay 222.

Beam directing unit 210, as illustrated in the exemplary implementation of FIG. 2A, may be separate from printing subsystem 208. Thus, in this example printing subsystem 208 utilizes beam directing unit 210 during the marking process but not during the printing process.

To the contrary, FIG. 2B illustrates another exemplary implementation wherein printing device 102' has a printing subsystem 208' that includes a beam directing unit 210 therein and uses all or part of beam directing unit 210 during the marking process and during the printing process. Thus, for example, a source for generating marking beam 212 may also be configured to support the printing process. One example is a laser that is used for printing within a laser printing device. In some implementations, such a dual-use source may also be configured to output a beam of higher (or lower) wattage for marking operations than what is output for printing operations.

Figure 3A:
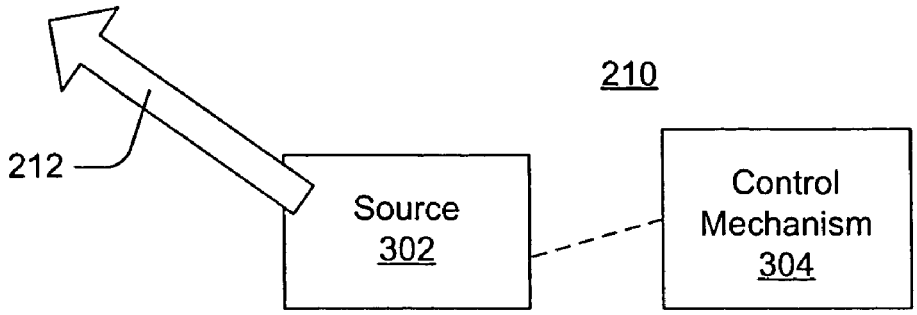
FIGS. 3A and 3B are block diagrams depicting, in greater detail, two exemplary beam directing units, for example, as in FIGS. 1, 2A-B, in accordance with certain embodiments of the present invention.
Figure 3B:
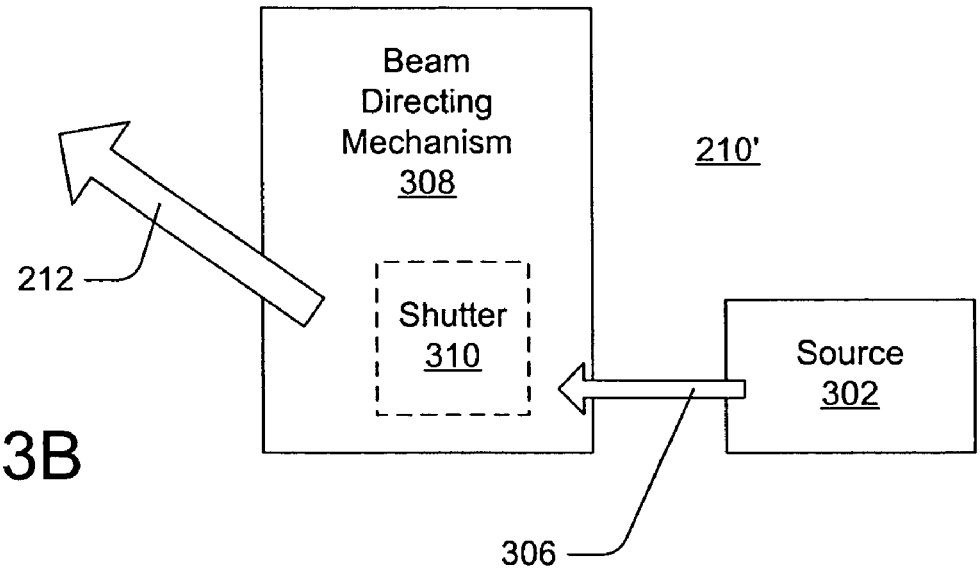

Attention is now drawn to FIGS. 3A and 3B, which are block diagrams depicting, in greater detail, two exemplary beam directing units 210, and 210', respectively.

In FIG. 3A beam directing unit 210 includes a source 302 configured to directly output marking beam 212. In this example, a control mechanism 304 is operatively configured to source 302 in a manner that allows controlled pointing of marking beam 212. By way of example, control mechanism 304 may include actuators that are responsive to logic 218 and/or 220 and move source 302. Here, source 302 may be separate from printing subsystem 208 (FIG. 2A) or included in within printing subsystem 208' (FIG. 2B).

In FIG. 3B beam directing unit 210' includes a source 302 configured to output a first beam 306 to a beam directing mechanism 308. Beam directing mechanism 308 takes first beam 306 and outputs marking beam 212. Beam directing mechanism 308 is configured to controllable redirect or otherwise modify first beam 306 to produce marking beam 212. To accomplish this beam directing mechanism 308 may include, for example, one or more a reflectors, refractors, magnifiers, lens, filters, mirrors, fiber optic elements, waveguides, focusing elements, and other like optical mechanisms.

In certain implementations, beam directing mechanism 308 may include a shutter mechanism 310 associated with source 302. Some laser printing devices include a protective shutter or other like mechanism that is opened/closed to selectively unblock/block the laser beam output. In certain instances it may be possible to redirect or otherwise modify the laser beam using shutter mechanism 310 in some manner. For example, shutter mechanism 310 can be configured with a surface/feature or surfaces/features that reflect the laser beam in some manner.

In certain other implementations, a control mechanism such as, control mechanism 304 of beam directing unit 210 in FIG. 3A may be adapted to control source 302 of beam directing unit 210' in FIG. 3B.

Figure 4:
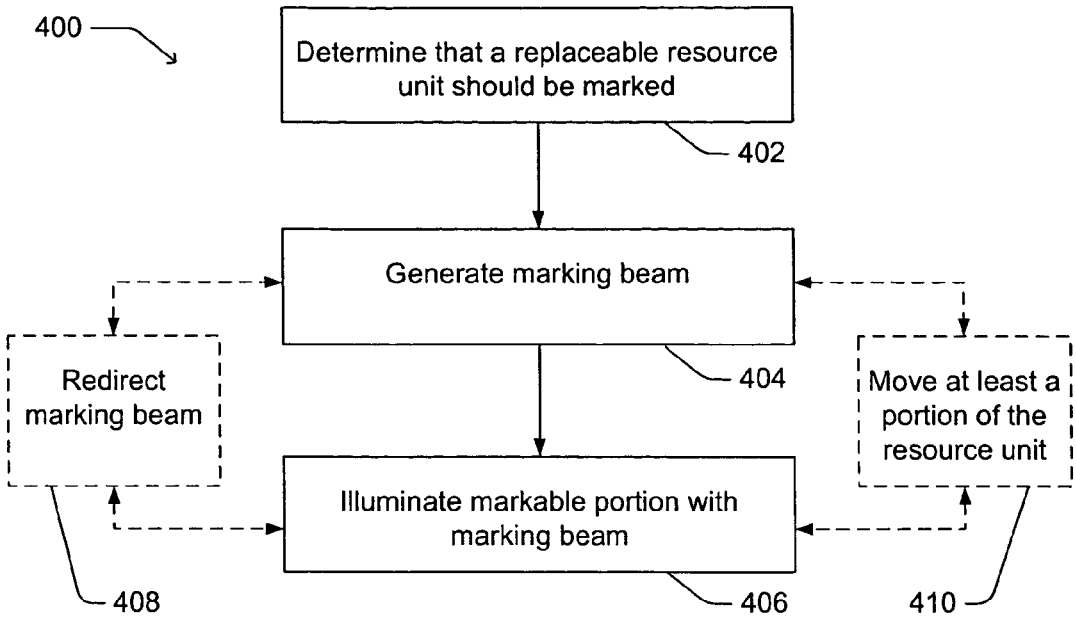
FIG. 4 is a flow diagram of a method for marking a replaceable resource unit, for example, as in printing devices in FIGS. 2A-B, in accordance with certain embodiments of the present invention.

FIG. 4 is a flow diagram of a method 400 for marking a replaceable resource unit, for example, as in printing devices in FIGS. 2A-B, in accordance with certain implementations of the present invention. In act 402, it is determined that a replaceable resource should be marked. By way of example, replaceable resource unit 202 may be marked upon insertion, prior to removal, and/or at one or more specific times while inserted. In certain instances, replaceable resource unit 202 is marked when a usage threshold level has been reached.

Next, in act 404, marking beam 212 is generated and at least a portion of markable portion 204 is illuminated with marking beam 212 in act 406. Prior to, during, and/or after either of acts 404 and 406, one or more of acts 408 and 410 are performed to allow for at least a portion of markable portion 204 to be marked in two-dimensions (e.g., x-axis and y-axis dimensions). In act 408, for example, marking beam 212 is redirected in at least one direction. In act 410, for example, at least a portion of replaceable resource unit 202 is moved in at least one direction.

FIGS. 5A, 5B, 5C, and 5D are illustrative diagrams depicting various exemplary markable portions of a replaceable resource unit, for example, as in printing devices in FIGS. 2A-B, in accordance with certain implementations of the present invention.

Figure 5A:
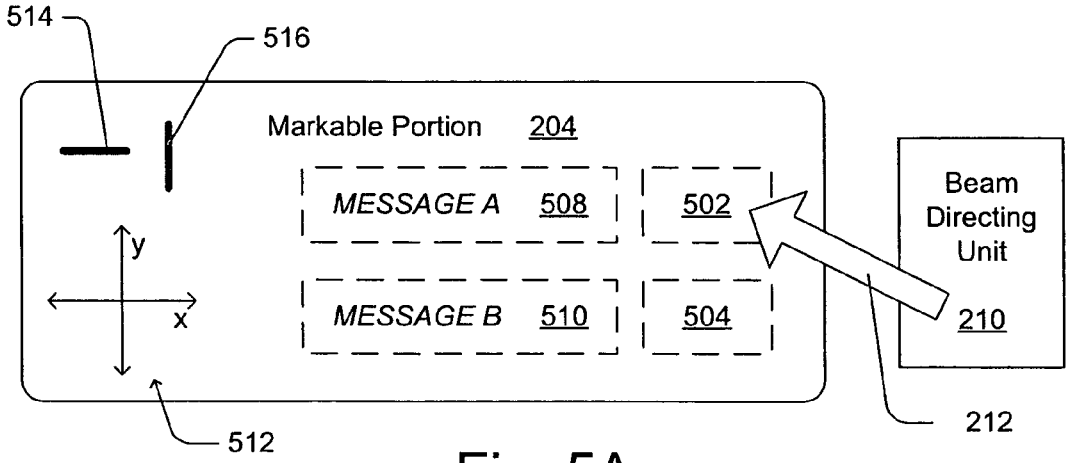
FIGS. 5A, 5B, 5C, and 5D are illustrative diagrams depicting various exemplary markable portions of a replaceable resource unit, for example, as in printing devices in FIGS. 2A-B, in accordance with certain embodiments of the present invention.

In FIG. 5A markable portion 204 includes a plurality of markable areas, namely first area 502 and second area 504, which can be separately illuminated and marked using marking beam 212. In the example, associated with first area 502 is a first information area 508, and associated with second area 504 is a second information area 510. First information area 508 may include, for example, "Message A" information readable by a person and/or machine. Second information area 510 may include, for example, "Message B" information also readable by a person and/or machine. Messages A or B may communicate, for example, the reason that replaceable resource unit 202 was marked (e.g., per act 402 in FIG. 4).

As illustrated in FIG. 5A, a directional indicator 512 depicts an x-axis and perpendicular y-axis for two-dimensional marking. A demonstrative mark 514 is shown along the x-axis direction as having a nominal width about equal to the width of marking beam 212 when it illuminates markable portion 204. Another demonstrative mark 516 is shown along the y-axis direction also having a nominal width about equal to the width of marking beam 212 when it illuminates markable portion 204.

Figure 5B:
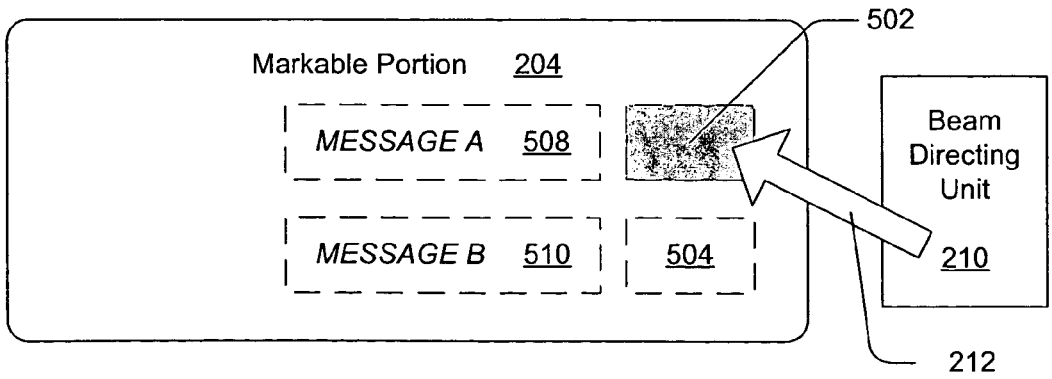
Figure 5C:
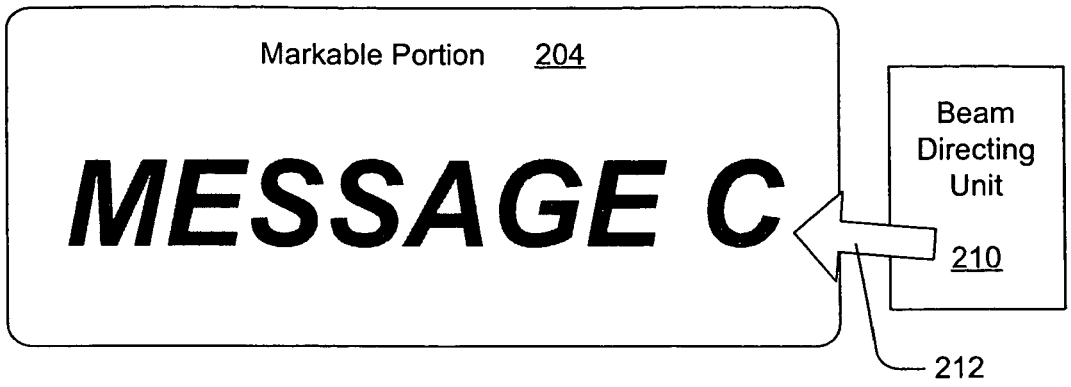
Figure 5D:
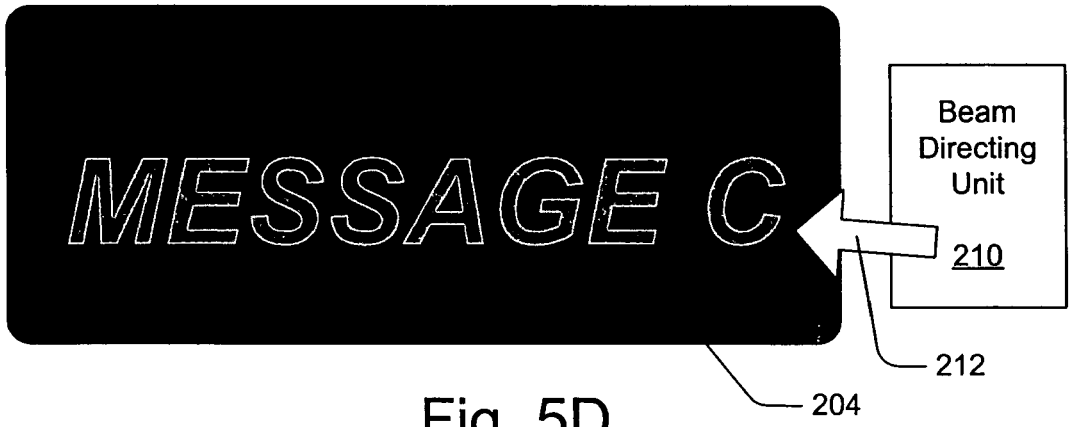

FIG. 5B is similar to FIG. 5A and further illustrates how, in this example, first area 502 has been marked in two-dimensions using marking beam 212. In this example, first area 502 became darker as a result of being marked. In other implementations, a marked area may become lighter, change color(s), etc., as a result of being marked. In certain examples as illustrated in FIGS. 5C and 5D, human and/or machine readable messages, such as "Message C" may be written to, erased from, or otherwise revealed or concealed within markable portion 204. In the example in FIG. 5C, Message C has a different shade/color (e.g., darker) than the surrounding area of markable portion 204. In the example in FIG. 5D, Message C has a different shade/color (e.g., lighter) than the surrounding area of markable portion 204.

Figure 6:
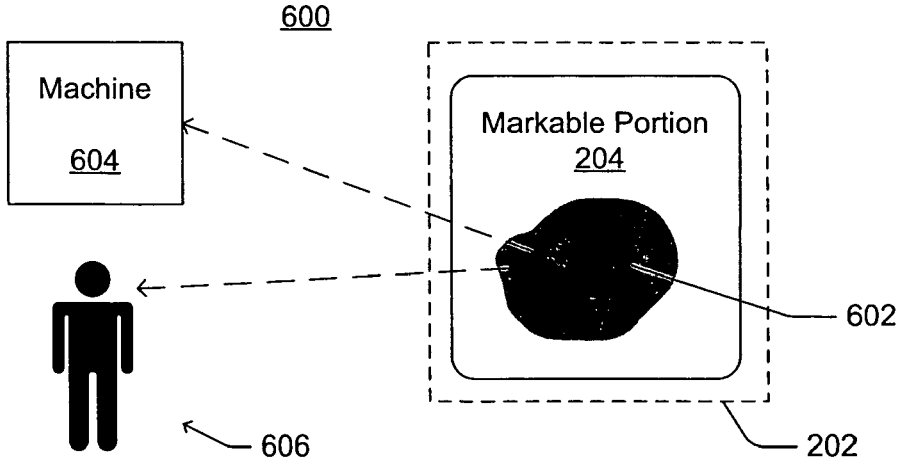
FIG. 6 is an illustrative diagram depicting the reading of a markable portion of a replaceable resource unit, in accordance with certain aspects of the present invention.

FIG. 6 is an illustrative diagram depicting an arrangement 600 for reading a markable portion of a replaceable resource unit, in accordance with certain aspects of the present invention. In a first variation of arrangement 600 a markable portion 204 of replaceable resource unit 202 is visibly "read" by a machine 604, which is configured to recognize the absence or presence of mark 602. Those skilled in the art will recognize that various types of machines are available for reading marks of various types. Here, mark 602 may be configured as needed to allow for machine 604 to detect it and/or gather information from it. Thus, for example, mark 604 may include a bar code or other like machine readable information. In a second variation, mark 602 is instead (or also) readable or other identifiable by a person 606. For example, Messages A, B and C may be read or identified by a person.

Although the above disclosure has been described in language specific to structural/functional features and/or methodological acts, it is to be understood that the appended claims are not limited to the specific features or acts described. Rather, the specific features and acts are exemplary forms of implementing this disclosure.

What is claimed is:

1. A method comprising:

generating a marking beam of electromagnetic energy within a printing device;

altering a visibly markable portion of a replaceable subsystem that is at least partially arranged within the printing device by illuminating at least part of the markable portion with the marking beam; and wherein illuminating at least part of the markable portion includes directing the marking beam in at least one direction within the printing device and, with the replaceable subsystem arranged within the printing device, moving at least a portion of the replaceable subsystem with respect to the at least one direction.

2. The method as recited in claim 1, wherein generating the marking beam further includes causing a laser within the printing device to generate the marking beam.

3. The method as recited in claim 2, further comprising causing the printing device to print using the laser.

4. The method as recited in claim 3, wherein the replaceable subsystem includes a toner cartridge and wherein moving the at least a portion of the replaceable subsystem further includes performing alienation of the toner cartridge before or while altering the markable portion.

5. The method as recited in claim 3, wherein the laser is configured to output a beam having a first level of intensity when the laser is used to print, the first level of intensity being different than a marking level of intensity of the marking beam.

6. The method as recited in claim 1, wherein directing the marking beam further includes directing the marking beam using at least one beam directing mechanism.

7. The method as recited in claim 6, wherein the at least one beam directing mechanism includes at least one beam directing mechanism selected from among a group of beam directing mechanisms comprising a reflecting mechanism, a refracting mechanism, a magnifying mechanism, a lens mechanism, a filter mechanism, a mirror mechanism, a fiber optic mechanism, a waveguide mechanism, and a focusing mechanism.

8. The method as recited in claim 6, wherein the at least one beam directing mechanism is further configured as a shutter mechanism for a source of the marking beam.

9. The method as recited in claim 6, wherein directing the marking beam further includes causing the at least one beam directing mechanism to move the marking beam in at least one dimension with respect to the markable portion.

10. The method as recited in claim 1, wherein the markable portion includes markable material that is arranged on at least one surface of the replaceable subsystem.

11. The method as recited in claim 10, wherein the markable material is arranged on the at least one surface using an applied label.

12. The method as recited in claim 1, wherein the replaceable subsystem includes a toner cartridge.

13. A method comprising:

generating a marking beam of electromagnetic energy within a printing device;

altering a visibly markable portion of a replaceable subsystem that is at least partially arranged within the printing device by separately illuminating, with the marking beam, a first area of the markable portion and/or a second area of the markable portion distinct from the first area.

14. The method of claim 13, wherein altering a visibly markable portion of a replaceable subsystem by separately illuminating, with the marking beam, a first area and/or a second area comprises separately illuminating the first area and then the second area.

15. The method of claim 13, wherein:

the first area is associated with a first message readable by a person such that altering the markable portion by illuminating the first area indicates the first message; and the second area is associated with a second message readable by a person such that altering the markable portion by illuminating the second area indicates the second message.

16. A printing device comprising:

a housing;

a replaceable resource unit that is at least partially arranged within the housing, the replaceable resource unit having a visibly markable portion;

a beam directing unit arranged within the housing, the beam directing unit configured to illuminate at least part of the markable portion using a marking beam of electromagnetic energy and to direct the marking beam in at least one direction within the printing device while illuminating the markable portion; and a resource unit engaging unit arranged within the housing and configured to, with the replaceable subsystem arranged within the housing, move at least the visibly markable portion of the replaceable subsystem with respect to the at least one direction before or while the beam directing unit illuminates the part of the markable portion.

17. The printing device as recited in claim 16, wherein the beam directing unit includes a laser configured to output the marking beam.

18. The printing device as recited in claim 17, wherein the laser is further configured for use by the printing device to print.

19. The printing device as recited in claim 18, wherein the laser is configured to output a beam having a first level of intensity when the laser is used to print, the first level of intensity being different than a marking level of intensity of the marking beam.

20. The printing device as recited in claim 16, wherein the replaceable subsystem includes a toner cartridge and wherein the resource unit engaging unit is configured to performing alienation of the toner cartridge before or while the beam directing unit illuminates the part of the markable portion.

21. The printing device as recited in claim 16, wherein the beam directing unit includes a source configured to output the marking beam and the beam directing unit is configured to controllably position the source.

22. The printing device as recited in claim 16, wherein the beam directing unit includes a source configured to output the marking beam and at least one beam directing mechanism arranged to direct the marking beam in the at least one direction.

23. The printing device as recited in claim 22, wherein the at least one beam directing mechanism includes at least one beam directing mechanism selected from among a group of beam directing mechanisms comprising a reflecting mechanism, a refracting mechanism, a magnifying mechanism, a lens mechanism, a filter mechanism, a mirror mechanism, a fiber optic mechanism, a waveguide mechanism, and a focusing mechanism.

24. The printing device as recited in claim 22, wherein the at least one beam directing mechanism is further configured as a shutter mechanism for the source.

25. The printing device as recited in claim 16, wherein the markable portion includes markable material that is arranged on at least one surface of the replaceable resource unit.

26. The printing device as recited in claim 25, wherein the markable material is arranged on the at least one surface using an applied label.

27. The printing device as recited in claim 16, wherein the replaceable resource unit includes a toner cartridge.

28. A printing device comprising:

a housing;

a replaceable resource unit that is at least partially arranged within the housing, the replaceable resource unit having a visibly markable portion; and a beam directing unit arranged within the housing, the beam directing unit configured to direct a marking beam of electromagnetic energy in a first direction within the printing device to illuminate a first area of the markable portion and/or to direct the marking beam in a second direction within the printing device to illuminate a second area of the markable portion of the replaceable subsystem distinct from the first area.

29. The printing device of claim 28, wherein the beam directing unit configured to direct the marking bean in a first direction to illuminate a first area and/or to direct the marking beam in a second direction to illuminate a second area comprises the beam directing unit configured to direct the marking beam to separately illuminate the first area and then the second area.

30. The printing device of claim 28, wherein:

the first area is associated with a first message readable by a person such that altering the markable portion by illuminating the first area indicates the first message; and the second area is associated with a second message readable by a person such that altering the markable portion by illuminating the second area indicates the second message.

31. A printing device comprising:

a housing;

a replaceable resource unit that is at least partially arranged within the housing, the replaceable resource unit having a portion markable visibly to a person, the markable portion being erasable such that information visible to a person may be alternately marked on and erased from the markable portion; and a beam directing unit arranged within the housing and configured to mark information on and erase information from the markable portion by illuminating the markable portion using a marking beam of electromagnetic energy generated by a laser that is configured for use by the printing device to print.

32. The printing device of claim 31, wherein the beam directing unit is configured to to separately illuminate a first area of the markable portion and/or a second area of the markable portion distinct from the first area.

33. The printing device of claim 32, wherein:

the first area is associated with a first message readable by a person such that marking the markable portion by illuminating the first area indicates the first message; and the second area is associated with a second message readable by a person such that marking the markable portion by illuminating the second area indicates the second message.

* * * * *

UNITED STATES PATENT AND TRADEMARK OFFICE

CERTIFICATE OF CORRECTION

PATENT NO. : 7,333,125 B2
APPLICATION NO. : 10/975305
DATED : February 19, 2008
INVENTOR(S) : Quintin T. Phillips et al.

It is certified that error appears in the above-identified patent and that said Letters Patent is hereby corrected as shown below:

In column 10, line 17, in Claim 29, delete “bean” and insert -- beam --, therefor.

In column 10, line 48, in Claim 32, before “separately” delete “to”.

Signed and Sealed this

Twelfth Day of August, 2008

JON W. DUDAS
*Director of the United States Patent and Trademark Office*